US009083097B2

(12) United States Patent
Feye-Hohmann et al.

(10) Patent No.: US 9,083,097 B2
(45) Date of Patent: Jul. 14, 2015

(54) CABLE CONNECTION, IN PARTICULAR FOR PHOTOVOLTAIC SYSTEMS

(75) Inventors: Juergen Feye-Hohmann, Detmold (DE); Thomas Scheib, Bad Pyrmont (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 13 days.

(21) Appl. No.: 13/810,249

(22) PCT Filed: Jun. 27, 2011

(86) PCT No.: PCT/EP2011/003157

§ 371 (c)(1),
(2), (4) Date: Jan. 15, 2013

(87) PCT Pub. No.: WO2012/007099

PCT Pub. Date: Jan. 19, 2012

(65) Prior Publication Data

US 2013/0122733 A1 May 16, 2013

(30) Foreign Application Priority Data

Jul. 16, 2010 (DE) ..... 10 2010 027 525

(51) Int. Cl.

| | |
|---|---|
| ***H01R 4/24*** | (2006.01) |
| ***H01R 13/207*** | (2006.01) |
| ***H01R 4/50*** | (2006.01) |
| ***H01R 4/52*** | (2006.01) |
| *H01R 13/512* | (2006.01) |

(52) U.S. Cl.

CPC ..... *H01R 13/207* (2013.01); *H01R 4/5033* (2013.01); *H01R 4/52* (2013.01); *H01R 13/512* (2013.01)

(58) Field of Classification Search

CPC ..... H01R 4/5033; H01R 11/281
USPC ..... 439/428, 427
See application file for complete search history.

(56) References Cited

U.S. PATENT DOCUMENTS

| | | | | |
|---|---|---|---|---|
| 6,752,667 | B2 * | 6/2004 | Ferderer | 439/729 |
| 6,857,895 | B2 * | 2/2005 | Korte et al. | 439/428 |
| 2003/0054702 | A1 | 3/2003 | Ferderer | |

FOREIGN PATENT DOCUMENTS

| | | | |
|---|---|---|---|
| DE | 897439 | C | 11/1953 |
| DE | 10145324 | A1 | 4/2003 |
| DE | 102006029075 | A1 | 1/2007 |

OTHER PUBLICATIONS

European Patent Office, International Search Report in International Patent Application No. PCT/EP2011/003157 (Oct. 7, 2011).

* cited by examiner

*Primary Examiner* — Phuong Dinh
(74) *Attorney, Agent, or Firm* — Leydig, Voit & Mayer, Ltd.

(57) ABSTRACT

A cable connection, preferably for photovoltaic systems, having a contact housing and a connection housing. The connection housing can be connected to the contact housing and serves to accommodate a cable which can be configured as required and has a conductor. The connection housing is intended to accommodate the cable which is to be connected and has the conductor. A contact needle for making contact with the conductor of the cable which is to be connected is arranged on the contact housing and a spring device is intended to radially surround the conductor and the contact needle and to press together said conductor and contact needle in a spring-elastic manner.

11 Claims, 3 Drawing Sheets

CABLE CONNECTION, IN PARTICULAR FOR PHOTOVOLTAIC SYSTEMS

CROSS REFERENCE TO RELATED APPLICATIONS

Figure 1:
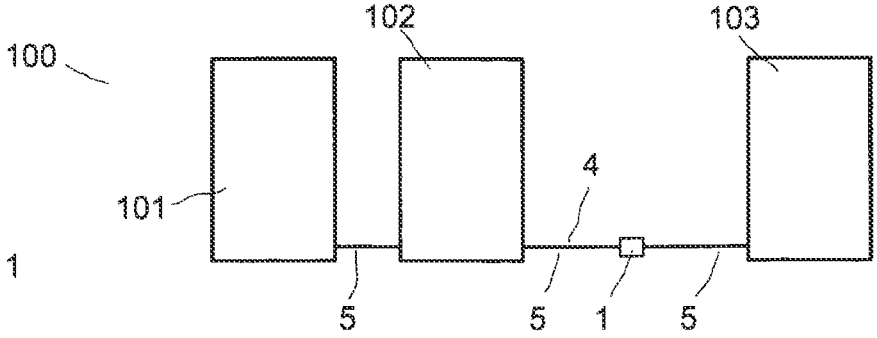

This application is a U.S. national phase application under 35 U.S.C. §371 of International Application No. PCT/EP2011/003157, filed on Jun. 27, 2011, and claims benefit to German Patent Application No. DE 10 2010 027 525.5, filed on Jul. 16, 2010. The international application was published in German on Jan. 19, 2012, as WO 2012/007099 A1 under PCT Article 21(2).

The invention relates to a cable connection, in particular for use in photovoltaic systems. The cable connection according to the invention is used in particular for the electrical connection of individual solar modules and is suitable for transferring the relevant current intensities and voltages securely and permanently.

Photovoltaic systems are designed for long-term operating periods of 20 years or more and are often installed on the roofs of houses and industrial facilities. They make a significant contribution to the production of electricity. The amount of electricity produced is regularly fed into the public electricity network and is therefore generally available. Even smallish systems covering in the region of a few tens of square meters can produce 10,000 kW hours of electricity and more annually.

Roof-installed solar modules are linked together electrically, e.g. via plug-in connections, during installation.

Plug-in connections and cable connections for the connection of solar modules have become well-known for such purposes. The known cable connections function reliably and also permanently. As the installation of photovoltaic systems on roofs and the like is progressively spreading, it is not always specialist companies which specialise in electric wiring that carry out the installations but rather increasingly companies which have geared themselves to the installation of photovoltaic modules on roof surfaces.

Installation on roof surfaces is often subject to more difficult conditions as many roofs are inclined.

The failure of a single cable connection can lead to considerable maintenance effort as it may be necessary to examine all the cable connections in order to find the cable connection which is faulty. An increased need for maintenance triggered due to the cable connections can have an adverse effect on business. It is therefore necessary to be able to guarantee a reliable operating period of many years.

Special tools for the most varied connections are frequently not available on site. It is therefore advantageous if the installation work to be carried out can be managed with relatively few special electrical tools even if the connection cables of individual solar modules have to be flexibly extended or configured as required in order to adapt them to the structural conditions on site.

The solar modules and the cable connections associated with them are exposed on the roofs to the environmental conditions which prevail there. This means that the cable connections may be exposed to high temperatures of above 40 degrees centigrade in the summer and temperatures far below zero degrees centigrade in the winter while at the same time moisture, in the form of rain and/or snow, also affects the cable connections.

Under these sharply fluctuating conditions, the cable connections must make a contact permanently and reliably for the long operating periods planned.

The object of the present invention is therefore to provide an electrical cable connection, in particular for use in photovoltaic systems, which reliably makes a permanent electrical contact and is relatively easy to install.

This object is achieved by the cable connection having the features of claim 1. Preferred developments of the invention are the subject-matter of the dependent claims. Further advantages and features will emerge from the embodiment.

An electrical cable connection according to the invention, in particular for solar cables on photovoltaic systems comprises at least one contact housing and at least one connection housing. The connection housing can be connected to the contact housing and the connection housing is provided with a conductor to accommodate at least one cable which can be configured as required. The connection housing serves to accommodate the cable to be connected together with the conductor. A contact needle for contacting the conductor of the cable which is to be connected is arranged on the contact housing. A spring device is provided to radially surround the conductor and the contact needle at least partially and to press together said conductor and contact needle in a spring-elastic manner.

The cable connection according to the invention has many advantages. One significant advantage of the cable connection according to the invention is that the spring device radially surrounds the conductor and the contact needle and presses them together in a spring-elastic manner. As a result, this facilitates a reliable electrical contact between the contact needle and the connected conductor even after extended and long operating periods.

A further advantage is that a cable which can be configured as required can be accommodated on the connection housing which means that flexible installation and flexible extension of connection cables for solar modules is possible. Furthermore, the cable connection can be of compact design.

The spring device is configured in particular as a separate part and in the joined state radially surrounds the conductor and the contact needle. The spring device need not radially surround the contact needle and the conductor completely, rather it is sufficient if the spring device presses together the contact needle and the conductor from two or more sides in order to make a reliable and durable contact.

In a preferred development, the spring device surrounds the insulating layer of the cable and presses via the insulating layer on the conductor contained therein and the contact needle inserted there in order to exert permanent pressure on said conductor and contact needle. In the process, the insulating layer can serve in particular as a spring-elastic accumulator.

Such a configuration utilises the elastic properties of the insulating layer in order to exert permanent pressure on the electrical connection between the conductor and the contact needle. Settlement phenomena and the like are equalised by the elastic effect of the spring device and the insulating layer in such a manner that reliable permanent contacting is enabled.

In a further preferred embodiment, the spring device surrounds the stripped conductor, in particular directly. A small radial gap can be provided between the stripped conductor and the spring device in the unconnected state. Such a radial gap between conductor and spring device in the unconnected state ensures that it is easily possible to insert the stripped conductor into the spring device.

If the contact needle is inserted into the conductor, the radial volume of the conductor with the contact needle inserted increases. As a result, the radial gap is bridged and the conductor with the inserted contact needle is pressed radially against the spring device such that the spring device exerts permanent pressure on the conductor with the contact needle inserted.

Such an embodiment, in which the spring device surrounds the stripped conductor, facilitates particularly long and secure contact times as the spring device is in direct contact with the conductor and the contact needle as appropriate and therefore it is not possible for the insulating layer to flow out of the spring device. Depending on the insulating material used, the softer insulating layer may be squeezed out through the narrow joint between the spring device and the conductor or contact needle which may possibly reduce the contact force. This can be prevented by using appropriate materials and dimensions.

If the insulation is used as a spring-elastic accumulator, said insulation can also assume a sealing function in addition to the spring-elastic effect as small and minute gaps are reliably sealed due to the pressure applied, thus making it possible to achieve a particularly high level of imperviousness against penetrating moisture.

If the insulating layer of the cable is removed at least partially or completely prior to connection and if the spring device directly surrounds the conductor of the cable, then an additional sealing compound or sealing device can be provided around the spring device to prevent the penetration of moisture even more reliably.

In all embodiments, it is especially preferable for the spring device to be capable of installation in the connection housing. In particular, the spring device is installed in the connection housing and is preferably accommodated there captively. Captive accommodation of the spring device facilitates particularly easy and reliable installation as the fitter does not have to pay attention to whether or not the spring device must be inserted in the connection housing.

In preferred embodiments, the spring device comprises at least one spring sleeve. The spring sleeve preferably has a cylindrical receiving region for the conductor of the cable. If necessary, the spring sleeve can have a funnel-shaped insertion region which prevents the spring sleeve from catching when the conductor is inserted.

The conductor, which in particular consists of a plurality of cores, can be pushed reliably and reproducibly, in the case of a spring sleeve with slightly enlarged internal diameter or in the case of a funnel-shaped insertion region, into the spring sleeve without individual cores catching on edges or the like and becoming bent.

The spring device is preferably slotted. It is possible, for example, that the spring sleeve has a slot parallel to the axis of said spring sleeve as a result of which the spring sleeve has good elastic and flexible properties. It is possible that the ends of the slots overlap such that the spring sleeve extends spirally around an accommodated conductor. It is also possible, however, that the ends of the slots adjoin each other or are a certain distance from each other.

A spiral slot which extends not only in the axial direction but also extends spirally around the spring sleeve is especially preferable. Due to this, individual cores of the conductor are even more reliably prevented from being forced outwards out of the spring sleeve which would result in a decrease of the press force of the spring sleeve on the conductor and the contact needle accommodated therein.

It is especially preferable for the spring device to be made at least in part of a metal. In particular, the spring device may consist of a flexible metal and in particular of spring steel.

However, it is also possible and preferable that the spring device consists of a plastics material. A fibre-reinforced plastics material, for example, is possible.

However, it is also possible that the spring device consists of a viscoelastic plastics material. With a viscoelastic spring device, either an outer sleeve or the connection housing, for example, applies the required opposing force in order to apply the necessary spring force when pushing in the contact needle. A viscoelastic spring device concentrically surrounding the conductor with the contact needle accommodated therein, having in turn a sleeve concentrically arranged around it or having the concentrically provided connection housing, can absorb high forces since the force into the sleeve or into the connection housing is applied radially and since the spring sleeve or the connection housing absorbs this force along the periphery and dissipates it.

In all embodiments, it is preferable for a thread to be disposed on the contact housing, said thread being intended to cooperate with a thread provided on the connection housing in order to insert the contact needle into the conductor of the cable in a defined manner from the front when screwing together said contact housing and said connection housing. In particular, the contact housing has an internal thread and the connection housing has an external thread. The contact needle is pressed into the conductor as a result of the screwing motion. In the process, due to the thread pitch, a relatively small torsional force generates a high axial insertion force of the contact needle into the conductor of the connection cable. At the same time, the contact needle guarantees defined full insertion into the conductor which ensures a large contact surface for transferring the electricity which means that permanently high currents can be transferred where high voltages are present.

At the same time, due to the design chosen, it is possible to implement a cable connection of compact design whose outer diameter is smaller than three to four times the outer diameter of a solar cable that is to be connected. As a result of this, the cable connection can also be routed in narrow ducts, sections and the like, which enables especially flexible use of the cable connection for joining solar modules of a photovoltaic system.

Further advantages and features of the present invention will emerge from the embodiments which are explained in the following with reference to the accompanying figures.

Figure 2:
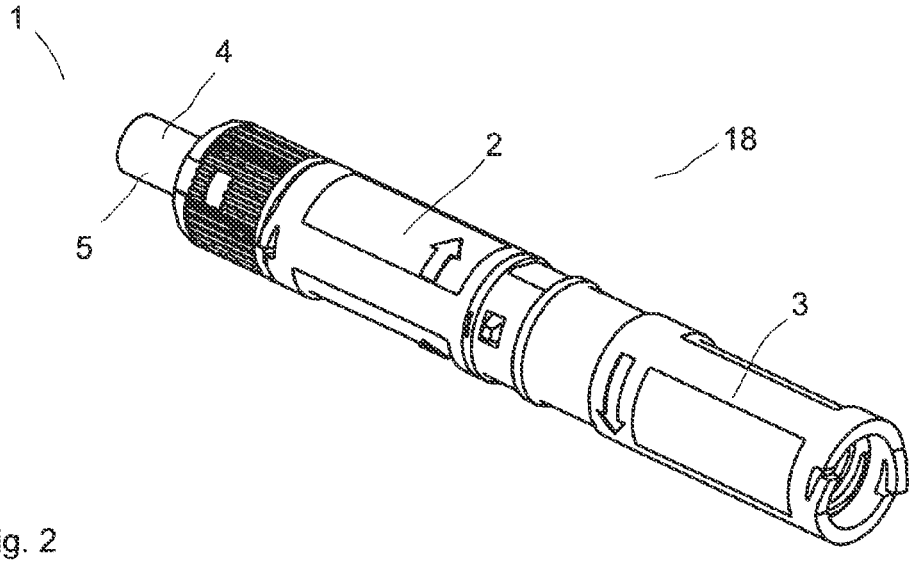
Figure 3:
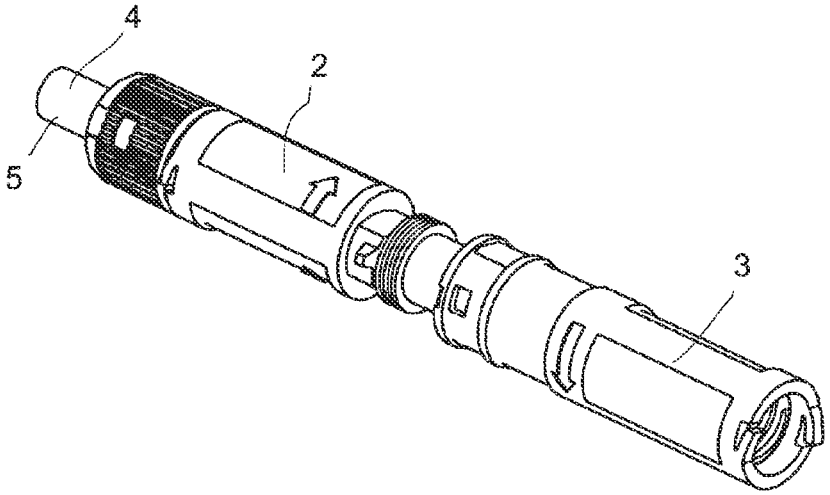
Figure 4:
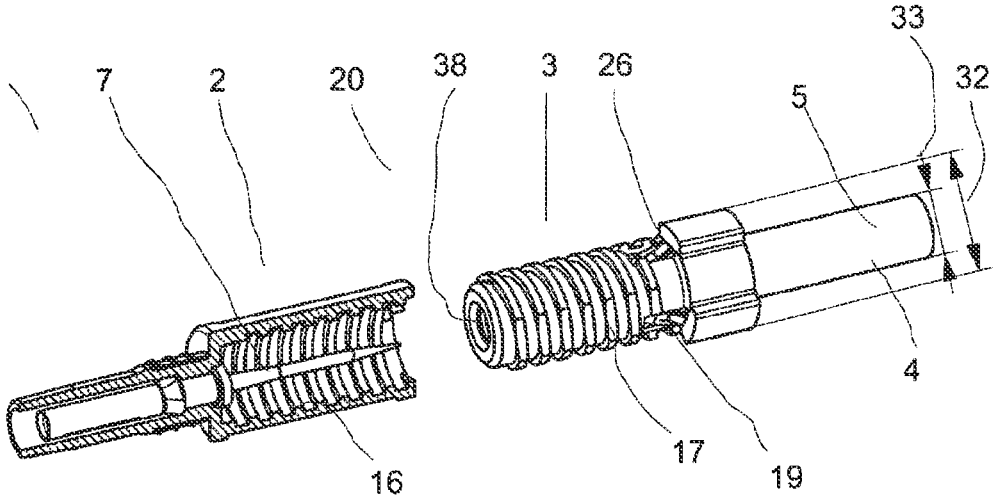
Figure 5:
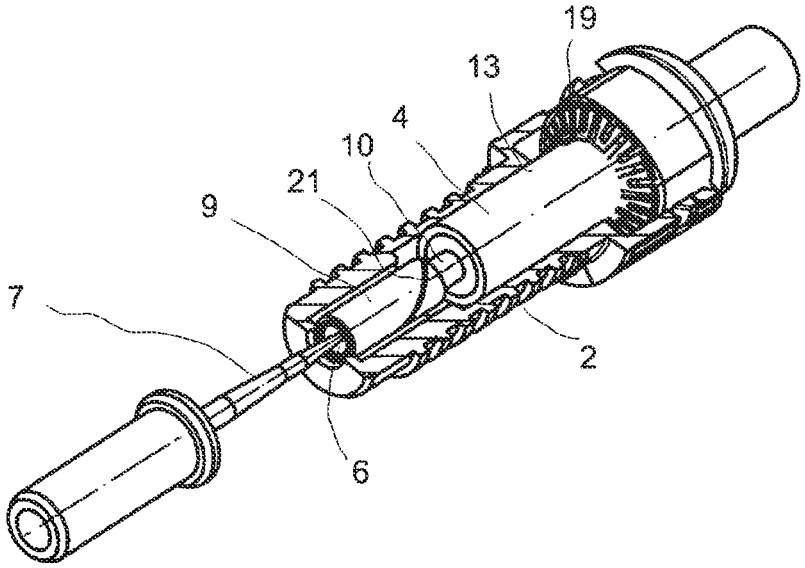
Figure 6:
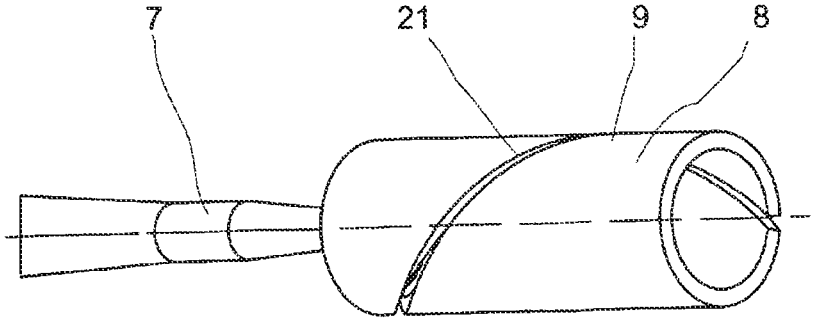
Figure 7:
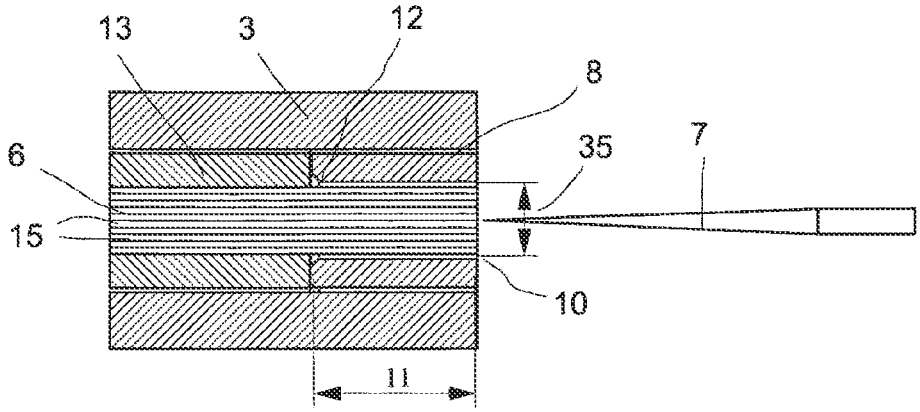
Figure 8:
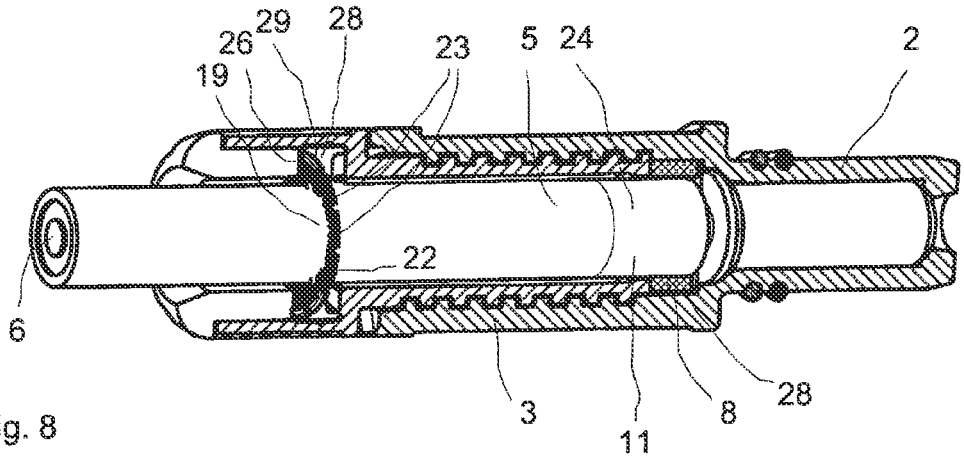

The figures show:

FIG. 1 a schematic illustration of a photovoltaic system whose modules are joined by way of a cable connection according to the invention;

FIG. 2 the cable connection according to FIG. 1 in the joined state;

FIG. 3 the cable connection according to FIG. 2 when making and breaking the connection;

FIG. 4 the cable connection according to FIG. 2 in a partially illustrated cross-section in the unjoined state;

FIG. 5 a schematic illustration of a perspective view as the contact needle penetrates the conductor;

FIG. 6 the contact needle and the spring sleeve of the cable connection according to FIG. 5;

FIG. 7 a schematised cross-section of a cable connection prior to full insertion of the contact needle;

FIG. 8 a cable connection in the joined state in cross-section; and

Figure 9:
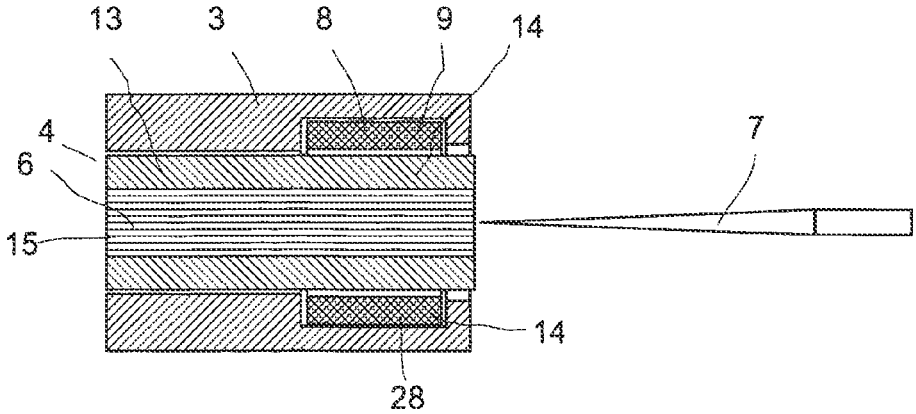

FIG. 9 a further embodiment of a cable connection in a schematic cross-section prior to full insertion of the contact needle.

FIG. 1 shows a highly schematic view of a photovoltaic system 100 which in the basic example here has three solar modules 101, 102 and 103 which are equipped with photovoltaic cells, not illustrated in detail, in order to convert incident sunlight into electric current.

Individual solar modules 101 to 103 of photovoltaic system 100 are joined together by way of cables 4 configured as solar cables 5 in order to make the necessary electrical connection.

Solar cables 5 route away the electric power which is generated but can also be supplied additionally with control signals or sensor signals so that photovoltaic system 100 can be suitably controlled.

The normal gap between a solar module 102 and a solar module 103 varies on light shafts, roof surfaces, windows or other structural features and conditions.

A larger gap between solar modules 102 and 103 must be bridged by extending connection cable 4.

As such photovoltaic installations are frequently carried out on inclined roof surfaces and as not every tool is always to hand when installing thereon, easy installation without particular special tools offers considerable advantages.

It is also advantageous if electric cable connection 1 is of compact design so that it can also be threaded through sections, cable ducts or other small spaces.

At the same time, it is possible for cable connection 1 to be joined on one side to a cable 4, which is configured as required, or to be joined on both sides to cables 4, which are configured as required. In the case where two-sided joining is possible, a symmetrical construction is particularly advantageous.

FIG. 2 shows cable connection 1 in a perspective view in joined state 18 in which contact housing 2 is joined to connection housing 3. Connection cable 4 represented as solar cable 5, which exits connection housing 3, is not shown here.

FIG. 3 shows cable connection 1 in a perspective view in which contact housing 2 and connection housing 3 are again partially detached from each other by being twisted against each other or are partially detached in the course of making the connection.

FIG. 4 shows a partially cutaway schematic illustration of cable connection 1 prior to making the connection in opened state 20.

A cable 4 which is configured as required has been pushed into connection housing 3 until cable 4 and conductor 6 lie against entry surface 38. Connection housing 3 is configured as a hollow screw and has an external thread 17 which is provided for screwing into an internal thread 16 of contact housing 2.

Disposed centrically in the hollow cylindrical receiving region of contact housing 2 is a contact needle 7 which, on making the connection, fully enters conductor 6 of cable 4, which is accommodated on connection housing 3, from the front in a defined axial manner. By means of a number of turns which can be, for example, between three and ten depending on the application case, contact needle 7 is pushed in a defined manner over practically its complete length or at least a significant portion thereof into conductor 6 of cable 4 such that contact needle 7 is disposed as far as possible centrically in conductor 6 and can therefore make a large contact surface with conductor 6.

Provided on connection housing 3 is a slide-back safety guard 19 securing a cable 4, which is pushed into the connection housing configured as a hollow cylinder, against sliding back when contact needle 7 axially penetrates entry surface 38 of connection housing 3 from the front with the high penetration force. On entering and particularly as entry progresses, contact needle 7 broadens such that the axial force on cable 4, which has been pushed in, increases. At the same time, the radial pressure increases as conductor 6 or its cores 15 spread out radially and exert pressure outwards.

FIG. 5 shows a schematic perspective view in which individual parts have been omitted in order to make viewing easier. Contact needle 7 fully entering conductor 6 is clearly identifiable. Conductor 6 is surrounded here by a spring device 8. Insulating layer 13 of connection cable 4 has been removed over a stripped region 11 such that spring sleeve 9 directly surrounds stripped conductor 10.

Spring device 8 configured here as spring sleeve 9 has a spiral slot 21 which ensures high elasticity of spring sleeve 9 made here from an elastic metal. Annular-shaped slot 21 reliably prevents individual cores 15 of conductor 6 from penetrating outwards through the slot.

It is also possible to provide a slot 21 configured axially. If necessary, however, a core 15 of conductor 6 can exit radially outwards through slot 21. This must be taken into consideration during the design such that the remaining compressive pressure is still sufficient to securely guarantee the connection.

It is also possible for spring device 9 to be configured as a spiral spring whose individual turns are close together or are spaced apart from each other. Such a spring device 9 also enables the application of the necessary force on a conductor disposed therein when a contact needle is pushed in.

FIG. 6 shows contact sleeve 9 of FIG. 5 having a schematically inserted contact needle 7 in order to illustrate possible dimensioning.

In this case, a spiral annular slot 21 is provided in contact sleeve 9.

FIG. 7 shows, in a schematic illustration, a connection housing 3 with a cable 4 accommodated therein which has a stripped conductor 10 in a stripped region 11. Individual cores 15 of conductor 6 are surrounded here over the length of stripped region 11 by a spring device 8 in the form, for example, of a spring sleeve 9. In this case, in opened state 20, as illustrated in FIG. 7, there is a small radial gap between the internal diameter of spring sleeve 9 and the outer diameter of conductor 6 with the bundle of cores 15. The radial gap may, for example, be between 5 and 25% of the diameter of the conductor. In any case, the radial gap is dimensioned such that after the full insertion of a contact needle 7 into conductor 6, contact needle 7 applies a radial pressure to spring sleeve 9 by way of conductor 6 such that, for example, a spring sleeve 9 provided with an axial slot or an annular slot 21 expands elastically radially and transfers a corresponding spring force on conductor 6 and contact needle 7.

In the embodiment according to FIG. 7, spring device 8 or spring sleeve 9 is preferably made of metal. However, it is also possible that spring device 8 consists of a viscoelastic plastics material, for example. By inserting contact needle 7 into conductor 6, the radial volume is enlarged there such that the pressure is passed outwards to the viscoelastic spring device. Spring device 8 which is viscoelastic is limited here in its radial expansion by connection housing 3 surrounding spring device 8 such that a corresponding contact force is exerted on conductor 6 and contact needle 7 disposed therein.

Outer diameter 35 of stripped conductor 10 is preferably between twenty and seventy-five percent of outer diameter 33 of cable 4. Outer diameter 33 of cable 4 is preferably within a range between thirty-three and sixty-six percent or more of outer diameter 32 of cable connection 1 such that a compact design of cable connection 1 is facilitated.

If spring device 8 in the embodiment according to FIG. 7 is formed by a metal part, it is possible to implement a radially especially compact design of cable connection 1 since high elastic forces can be transferred to conductor 6 and contact needle 7 provided therein even by a radially thin spring sleeve 9.

FIG. 8 shows, in a schematic cutaway illustration, cable connection 1 in joined state 18 in which connection housing 3 is screwed into contact housing 2 and where contact needle 7, which is not visible here, is fully inserted into conductor 6.

FIG. 8 shows two variants. On one hand, it is possible for a spring device 8 made, for example, from a viscoelastic material or a metal to surround insulating layer 13 of connection cable 4 and to exert elastic pressure from the outside when contact needle 7 penetrates the conductor.

It is also possible for a stripped region 11 of conductor 6 to be surrounded by a spring device 24 which may consist of a viscoelastic material or metal in order to transfer corresponding forces from conductor 6 and contact needle 7. Spring device 8 provided radially further outwards can then, for example, consist of a viscoelastic material or the like and may serve as sealing device 28 of cable connection 1 in order to facilitate a permanently secure connection which is protected against moisture.

FIG. 8 further illustrates slide-back guard 19 which may include a spring device 22 with spring tongues 23 which prevent sliding back after cable 4 is pushed in since the spring tongues lie against insulating layer 13 of conductor 6 at an oblique angle and, if withdrawal is attempted, bury themselves further into insulating layer 13 of cable 4 while the outer ends of the spring tongues are supported on a ledge 26 in connection housing 3.

FIG. 9 shows, in a schematic cross-section, a further construction of a cable connection 1 in which cable 4 need not be stripped. Cable 4 pushed into connection housing 3 is surrounded radially with insulating layer 13 by spring device 8 which may in turn be configured here as spring sleeve 9. At the same time, spring sleeve 9 may have a slot 21 or may also completely surround insulating layer 13. After the insertion of contact needle 7 in conductor 6, said conductor 6 is expanded radially due to the additional volume of contact needle 7 as a result of which insulating layer 13 serves as a spring-elastic accumulator 14.

Even in the event of mechanical settlement phenomena or the like, the spring-elastic force of the insulating layer which is supported by surrounding spring device 8 is sufficient to facilitate a permanently impervious and reliable connection.

Overall, the invention provides a reliable cable connection 1 which permanently and securely facilitates an electrical contact between a connection cable 4 and a contact needle 7 and is configured, for example, as a plug-in connection. The connection can transfer high currents at high voltages and can be operated maintenance-free over long periods.

LIST OF REFERENCE NUMERALS

Electrical cable connection 1
Contact housing 2
Connection 3
Cable 4
Solar cable 5
Conductor 6
Contact needle 7
Spring device 8
Spring sleeve 9
Stripped conductor 10
Stripped region 11
Funnel-shaped insertion region 12
Insulating layer 13
Spring-elastic accumulator 14
Core 15
Internal thread 16
External thread 17
Joined state 18
Slide-back safety guard 19
Opened state 20
Slot 21
Spring device 22
Spring tongue 23
Spring device 24
Ledge 25
Sealing device 26
Conical contact surface 27
Outer diameter of the plug-in connector 28
Outer diameter of the cable 29
Outer diameter of the conductor 30
Entry surface 31
Photovoltaic system 100
Solar module 101-103

The invention claimed is:

1. A cable connection, preferably for photovoltaic systems, comprising a contact housing and at least one connection housing, wherein the connection housing can be connected to the contact housing and serves to accommodate at least one cable which can be configured as required and has a conductor, wherein the connection housing is provided to accommodate the cable which is to be connected with the conductor and that a contact needle for making contact with the conductor of the cable which is to be connected is arranged on the contact housing, wherein a spring device is intended to radially surround the conductor and the contact needle and to press together said conductor and contact needle in a spring-elastic manner;

wherein the spring device is captively disposed wholly within the connection housing.

2. The cable connection of claim 1, wherein the spring device surrounds the stripped conductor.

3. The cable connection of claim 1, wherein the spring device surrounds the insulating layer of the cable.

4. The cable connection of claim 3, wherein the insulating layer serves as a spring-elastic accumulator.

5. The cable connection of claim 1, wherein the spring device is incorporated into the connection housing.

6. The cable connection of claim 1, wherein the spring device comprises a spring sleeve.

7. The cable connection of claim 6, wherein the spring sleeve has a cylindrical receiving region for the conductor of the cable and a funnel-shaped insertion region.

8. The cable connection of claim 1, wherein the spring device is slotted.

9. The cable connection of claim 1, wherein the spring device consists of metal.

10. The cable connection of claim 1, wherein the spring device consists of at least one viscoelastic plastics material.

11. The cable connection of claim 1, wherein the conductor of the cable consists of a plurality of flexible cores.

* * * * *